US011255347B2

(12) United States Patent
Yang et al.

(10) Patent No.: US 11,255,347 B2
(45) Date of Patent: Feb. 22, 2022

(54) FAN VIBRATION DAMPING DEVICES, SYSTEMS AND/OR METHODS

(71) Applicant: Fortinet, Inc., Sunnyvale, CA (US)

(72) Inventors: Zhi Hon Yang, Surrey (CA); Shenghua Jiang, Jiangsu (CN); Keqin Chen, Coquitlam (CA)

(73) Assignee: Fortinet, Inc., Sunnyvale, CA (US)

( * ) Notice: Subject to any disclaimer, the term of this patent is extended or adjusted under 35 U.S.C. 154(b) by 456 days.

(21) Appl. No.: 15/269,466

(22) Filed: Sep. 19, 2016

(65) Prior Publication Data

US 2018/0080479 A1 Mar. 22, 2018

(51) Int. Cl.

| | |
|---|---|
| ***F04D 29/66*** | (2006.01) |
| ***F04D 19/00*** | (2006.01) |
| ***F04D 29/02*** | (2006.01) |
| ***F04D 29/60*** | (2006.01) |

(52) U.S. Cl.

CPC ..... *F04D 29/668* (2013.01); *F04D 19/002* (2013.01); *F04D 29/023* (2013.01); *F04D 29/601* (2013.01)

(58) Field of Classification Search

CPC .... F04D 29/668; F04D 29/023; F04D 29/325; F04D 19/002; F04D 29/522

See application file for complete search history.

(56) References Cited

U.S. PATENT DOCUMENTS

RE22,261 E * 2/1943 Kalischer ..... F24F 1/022 165/151
2,867,377 A * 1/1959 Lasko ..... F04D 29/646 417/234
3,504,533 A * 4/1970 Rodewalt ..... G01M 1/02 73/652

(Continued)

OTHER PUBLICATIONS

Russell, Daniel A., "The Dynamic Vibration Absorber", Graduate Program in Acoustics, The Pennsylvania State University, 2004-2011 (the year of publication is sufficiently earlier than the effective U.S. filing date and any foreign priority date so that the particular month of publication is not in issue), University Park, Pennsylvania.

*Primary Examiner* — Kenneth Bomberg
*Assistant Examiner* — Adam W Brown
(74) *Attorney, Agent, or Firm* — HDC Intellectual Property Law, LLP

(57) ABSTRACT

Vibration damping devices and methods utilizing the same for damping vibrations in a fan. A vibration damping device for a fan, the fan having an inlet side of a frame and an exhaust side of the frame and the frame retains a fan mechanism. The vibration damping device includes a mass $m_T$ which may include either: a block with a total mass $m_T$; or a finger guard and at least one resilient attachment member having a first spring characteristic, wherein resilient attachment member is configured to be connected to and retain the mass mT. The vibration damping device may be tunable to damp the vibration of fan by (a) varying the total mass $m_T$ of the block, or replacing the finger guard, and/or (Continued)

(b) replacing the at least one resilient attachment member with a second resilient attachment member having a second spring characteristic.

16 Claims, 9 Drawing Sheets

(56) References Cited

U.S. PATENT DOCUMENTS 4,583,912 A * 4/1986 Ball ..... F04D 29/669 415/119
4,819,439 A * 4/1989 Higham ..... F04B 35/045 310/12.32
5,030,068 A * 7/1991 Jacobs ..... F04D 29/626 417/363
5,641,340 A * 6/1997 Kagan ..... B01D 46/10 55/385.1
5,647,726 A * 7/1997 Sehgal ..... B64C 27/001 188/380
6,378,832 B1 * 4/2002 Li ..... F16F 1/3849 248/635
6,681,908 B2 * 1/2004 Davis ..... F16F 1/12 188/380
7,362,569 B2 * 4/2008 Chen ..... G06F 1/20 165/80.3
7,410,039 B2 * 8/2008 Or ..... F16F 7/104 188/267
7,488,152 B2 2/2009 Liang
9,189,038 B2 * 11/2015 Hartman ..... F04D 29/58
2006/0016482 A1 1/2006 Berens et al.
2008/0043430 A1 * 2/2008 Chen ..... G06F 1/20 361/679.34
2008/0302622 A1 * 12/2008 Ohtake ..... F16F 1/371 188/379
2010/0025017 A1 2/2010 Zhang et al.
2012/0063886 A1 3/2012 Tsai
2013/0272868 A1 10/2013 Sun

* cited by examiner

FAN VIBRATION DAMPING DEVICES, SYSTEMS AND/OR METHODS

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever. Copyright© 2016, Fortinet, Inc.

BACKGROUND

Field

Embodiments of the presently-described developments generally relate to fan vibration damping. In particular, implementations of the presently-described developments relate to fan vibration damping devices and methods for damping vibrations utilizing one or more fan vibration damping devices.

Description of the Related Art

With continuous advancement of sciences and technologies, reliance of people on various electronic products is on rise. During operation, internal components of electronic products such as computers and laptops generate heat. The heat must be dissipated to the outer side of the electronic products in time to alleviate the problem of overheating and deleterious effects resulting therefrom. Therefore, most of the electronic products are provided with one or more cooling fans disposed therein to keep electronic products working at an operation temperature within a specified range.

During operation, the cooling fan generates unwanted vibrations, with the result that noise is generated due to vibration of the computer casing. As the cooling fan is enclosed in the computer casing, vibration and noise generated therefrom is further amplified. Hence, controlling the fan vibrations has become an essential challenge for most electronic products involving cooling fans; as such vibrations can adversely affect other components present in the casing, such as hard discs, chips and the like.

Most existing approaches proposed so far have been focused on isolating the fan vibration from the attached system, such as by using soft mounting structures. However, generation of fan vibration itself is not controlled. The existing isolation methods can only provide limited energy absorbance. Remainder of the energy, unabsorbed by the isolation structures, emanates from the fan, eventually transforming into vibration and noise. In view of the shortcomings of existing systems for damping vibrations originating from the cooling fan, there is a need for improved vibration damping devices and methods for damping vibrations utilizing the same.

SUMMARY

Vibration damping devices and methods utilizing the same for damping vibrations in a fan are described.

An aspect of the present disclosure relates to a vibration damping device for a fan, wherein the fan includes an inlet side of a frame and an exhaust side of the frame, and wherein the frame retains a fan mechanism. The vibration damping device includes: a mass $m_T$ including zero or more weight elements; and at least one resilient attachment member having a first spring characteristic, wherein the at least one resilient attachment member is configured to be connected to and retain the mass $m_T$ to the frame retaining the fan mechanism; and wherein the vibration damping device is tunable to damp the vibration of the fan by any or a combination of (a) varying the mass $m_T$ by replacement or addition or subtraction of one or more weight elements, and (b) replacing the at least one resilient attachment member having the first spring characteristic with a second resilient attachment member having a second spring characteristic. In an implementation, the mass $m_T$ is one or more of: (a) a block including as the zero or more weight elements, zero or more plates and (b) a finger guard, wherein the block is configured to be connected to the frame between the inlet side of the frame and the exhaust side of the frame, and the finger guard is configured to be connected onto any or a combination of the inlet side of the frame and the exhaust side of the frame retaining the fan mechanism.

In an implementation, the vibration damping device is tunable to damp the vibration of the fan by being tunable to match the resonance frequency of the fan. In an implementation, the first resilient attachment member is made of a first material that has a shore hardness $A_1$, and the second resilient attachment member is made of a second material that has a shore hardness $A_2$. In an implementation, the at least one resilient attachment is made of a rubber material. In an implementation, the at least one resilient attachment defines at least one protrusion thereon. In an implementation, the zero or more plates are made of a metallic material. In an implementation, the zero or more plates are one or both of substantially triangular shape and having at least one groove defined therein. In an implementation, the frame is a substantially rectangular frame that is configured to retain the fan mechanism. In an implementation, the vibration damping device is coupled to the substantially rectangular frame at its corners.

Another aspect of the present disclosure relates to a method of damping vibration of a fan, the method including: realizing a vibration damping device by selecting a mass $m_T$ including zero or more weight elements; selecting at least one resilient attachment member having a first spring characteristic; and coupling the mass $m_T$ to the at least one resilient attachment member to realize the vibration damping device; tuning to damp the vibration of a the fan by any or a combination of (a) varying the mass $m_T$ by replacement or addition or subtraction of one or more weight elements, and (b) replacing the at least one resilient attachment member having a first spring characteristic with another resilient attachment member having a second spring characteristic; and disposing the vibration damping device between or at any or a combination of an inlet side of a frame and an exhaust side of the frame retaining the fan to damp vibrations of the fan.

In an implementation, the tuning to damp the vibration of the fan includes: matching the resonance frequency of the fan by (a) varying or (b) replacing of elements of the vibration damping device. In an implementation, the tuning to damp the vibration of the fan includes one or more of: calculating a resonance frequency $f_1$ for the fan; calculating a resonance frequency f2 for the vibration damping device comprising the mass $m_T$ and the at least one resilient attachment with the shore hardness A1; comparing the resonance frequency f1 of the fan with the resonance frequency f2 of the vibration damping device; wherein in case of a mismatch between the resonance frequency f1 of the fan and the resonance frequency f2 of the vibration damping device, either or both (a) the varying the mass $m_T$ by replacement or addition or subtraction of one or more weight elements, and (b) the replacing of the at least one resilient attachment member having a first spring characteristic with another resilient attachment member having a second spring characteristic are performed to arrive at a resonance frequency f3 that matches the resonance frequency f1 of the fan. In an implementation, the mass $m_T$ is one or more of: (a) a block including as the zero or more weight elements, zero or more plates and (b) a finger guard, wherein the block is configured to be connected to the frame between the inlet side of the frame and the exhaust side of the frame, and the finger guard is configured to be connected onto any or a combination of the inlet side of the frame and the exhaust side of the frame retaining the fan mechanism.

Still another aspect of the present disclosure relates to a vibration damping system, the system including: a fan including: a fan mechanism; an inlet side of a frame; and an exhaust side of the frame, the frame retaining a fan mechanism therewithin; and, a vibration damping device configured to be connected to the frame, the vibration damping device including: a mass $m_T$ including zero or more weight elements; and at least one resilient attachment member having a first spring characteristic, wherein the at least one resilient attachment member is configured to be connected to and retain the mass $m_T$ between or at any or a combination of the inlet side of the frame and the exhaust side of the frame retaining the fan mechanism; wherein the vibration damping device is tunable to damp the vibration of a the fan by any or a combination of (a) varying the mass $m_T$ by replacement or addition or subtraction of one or more weight elements, and (b) replacing the at least one resilient attachment member having the first spring characteristic with a second resilient attachment member having a second spring characteristic.

Other features of embodiments of the present disclosure will be apparent from the accompanying drawings and from the detailed description that follows.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
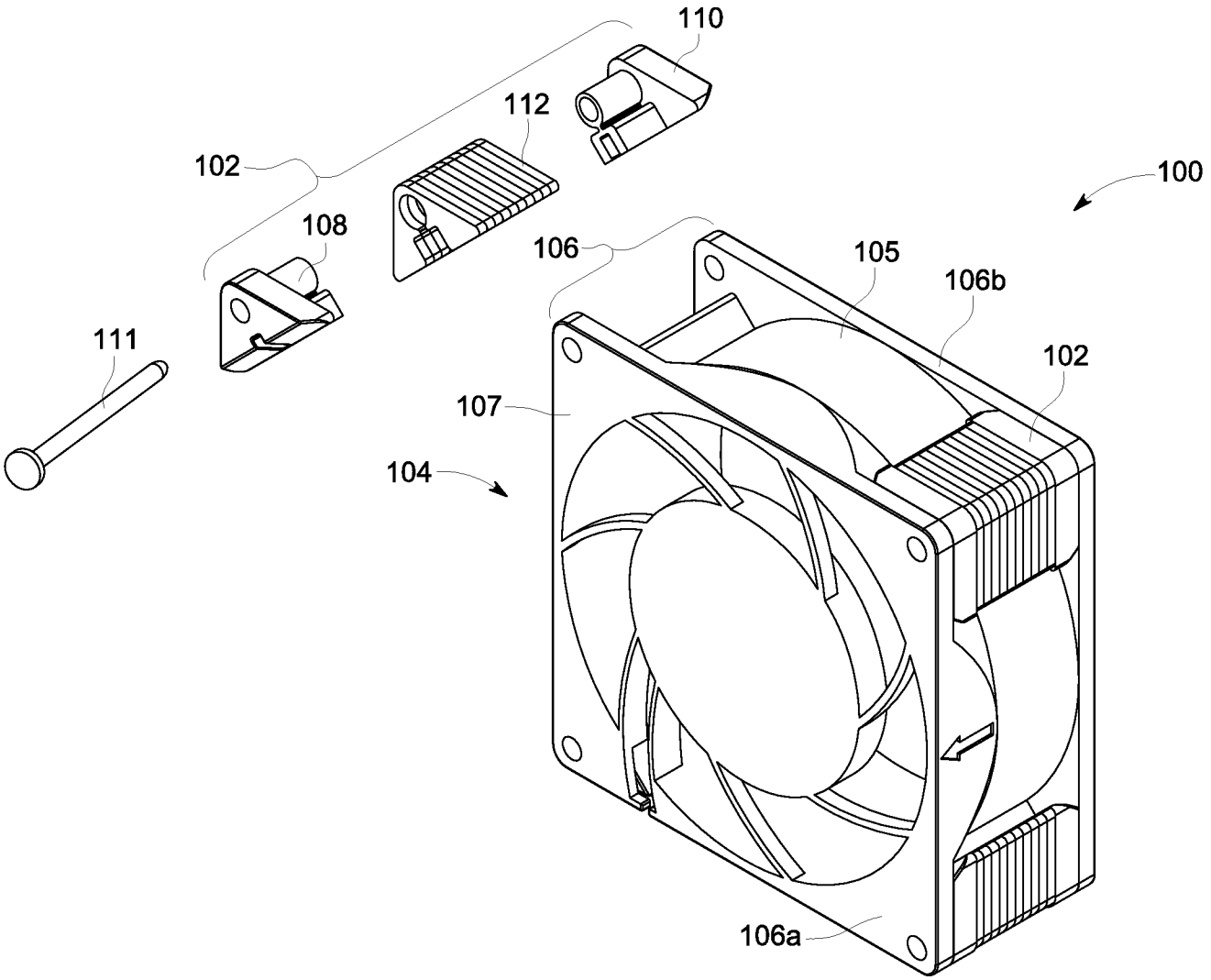
FIG. 1 illustrates an exemplary exploded view of a vibration damping device in combination with a fan in accordance with an implementation of the present subject matter.

Vibration damping devices and methods utilizing the same for damping vibrations in a fan are described. Embodiments of the present disclosure include various alternative apparatuses, systems and/or operations or functions, which will be described below. The apparatuses, systems and/or operations or functions may include and/or be performed on or by hardware components or may be embodied in machine-executable instructions, which may be used to cause a general-purpose or special-purpose processor programmed with the instructions to perform the operations or functionalities. Alternatively, operations or functions may be performed by a combination of hardware, software, firmware and/or by human operators.

If the specification states a component or feature "may", "can", "could", or "might" be included or have a characteristic, that particular component or feature is not required to be included or have the characteristic.

Exemplary implementations will now be described more fully hereinafter with reference to the accompanying drawings, in which exemplary implementations are shown. This disclosure may, however, be embodied in many different forms and should not be construed as limited to the implementations set forth herein. These implementations are provided so that this disclosure will be thorough and complete and will fully convey the scope of the disclosure to those of ordinary skill in the art. Moreover, all statements herein reciting implementations of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

An aspect of the present disclosure relates to a vibration damping device for a fan, wherein the fan includes an inlet side of a frame and an exhaust side of the frame, and wherein the frame retains a fan mechanism. The vibration damping device includes: a mass $m_T$ including zero or more weight elements; and at least one resilient attachment member having a first spring characteristic, wherein the at least one resilient attachment member is configured to be connected to and retain the mass $m_T$ to the frame retaining the fan mechanism; and wherein the vibration damping device is tunable to damp the vibration of the fan by any or a combination of (a) varying the mass $m_T$ by replacement or subtraction of one or more weight elements, and (b) replacing the at least one resilient attachment member having the first spring characteristic with a second resilient attachment member having a second spring characteristic. In an implementation, the mass $m_T$ is one or more of: (a) a block including as the zero or more weight elements, zero or more plates and (b) a finger guard, wherein the block is configured to be connected to the frame between the inlet side of the frame and the exhaust side of the frame, and the finger guard is configured to be connected onto any or a combination of the inlet side of the frame and the exhaust side of the frame retaining the fan mechanism. In an implementation, the vibration damping device is tunable to damp the vibration of the fan by being tunable to match the resonance frequency of the fan. In an implementation, the first resilient attachment member is made of a first material that has a shore hardness $A_1$ and the second resilient attachment member is made of a second material that has a shore hardness $A_2$. In an implementation, the at least one resilient attachment is made of a rubber material. In an implementation, the at least one resilient attachment defines at least one protrusion thereon. In an implementation, the zero or more plates are made of a metallic material. In an implementation, the zero or more plates are one or both of substantially triangular shape and having at least one groove defined therein. In an implementation, the frame is a substantially rectangular frame that is configured to retain the fan mechanism. In an implementation, the vibration damping device is coupled to the substantially rectangular frame at its corners.

FIG. 1 illustrates an exemplary exploded view of a vibration damping device 102 in combination with a fan 104 in accordance with an implementation of the present subject matter; together, one or more vibration damping devices 102 apart from or with a fan 104 may also and/or alternatively be known as a vibration damping system 100. In some implementations, a system 100 includes two or more devices 102, and in other implementations, a fan 104 is also/alternatively included.

As illustrated, the fan 104 includes a frame 106 and a fan mechanism 105 (fan blades or like or alternative fan component parts not separately shown in FIG. 1) retained therein. In an implementation, the frame 106 is of substantially rectangular shape. Alternatively, it can be of any shape known to or appreciated by a person skilled in the art without departing form scope and spirit of the present disclosure. The frame 106 includes an inlet side of a frame 106*b* and an exhaust side of the frame 106*a*. One or more vibration damping device(s) 102 is/are disposed between the inlet side of the frame 106*b* and the exhaust side of the frame 106*a*. In an implementation, a rod or bolt or screw or like elongated member, shown as 111, can be used to retain the one or more vibration damping device(s) 102 between the inlet side of the frame 106*b* and the exhaust side of the frame 106*a*. In an implementation, one or more vibration damping devices 102 can be coupled to the substantially rectangular frame 106 at one or more of the corners 107 of the frame 106.

In an exemplary implementation, the one or more vibration damping devices 102 can include one or both of the shown resilient attachment members 108 and 110, together with a mass $m_T$ including zero or more weight elements. In an implementation, a mass $m_T$ including zero or more weight elements is configured as a block 112 including zero, one or a plurality of plates, each plate having a defined mass, the masses of the corresponding plates possibly but not necessarily limited to being equal. The block 112 defines a mass $m_T$ by virtue of the zero, one or plurality of plates of defined masses. The resilient attachment members 108/110 on the other hand can be made of any resilient material, including but not limited to, plastic, rubber, other polymeric materials and the like as known to or appreciated by a person skilled in the art. In a preferred implementation, the resilient attachment members 108/110 can be made of a rubber or rubber-like material defining a spring characteristic.

Figure 2:
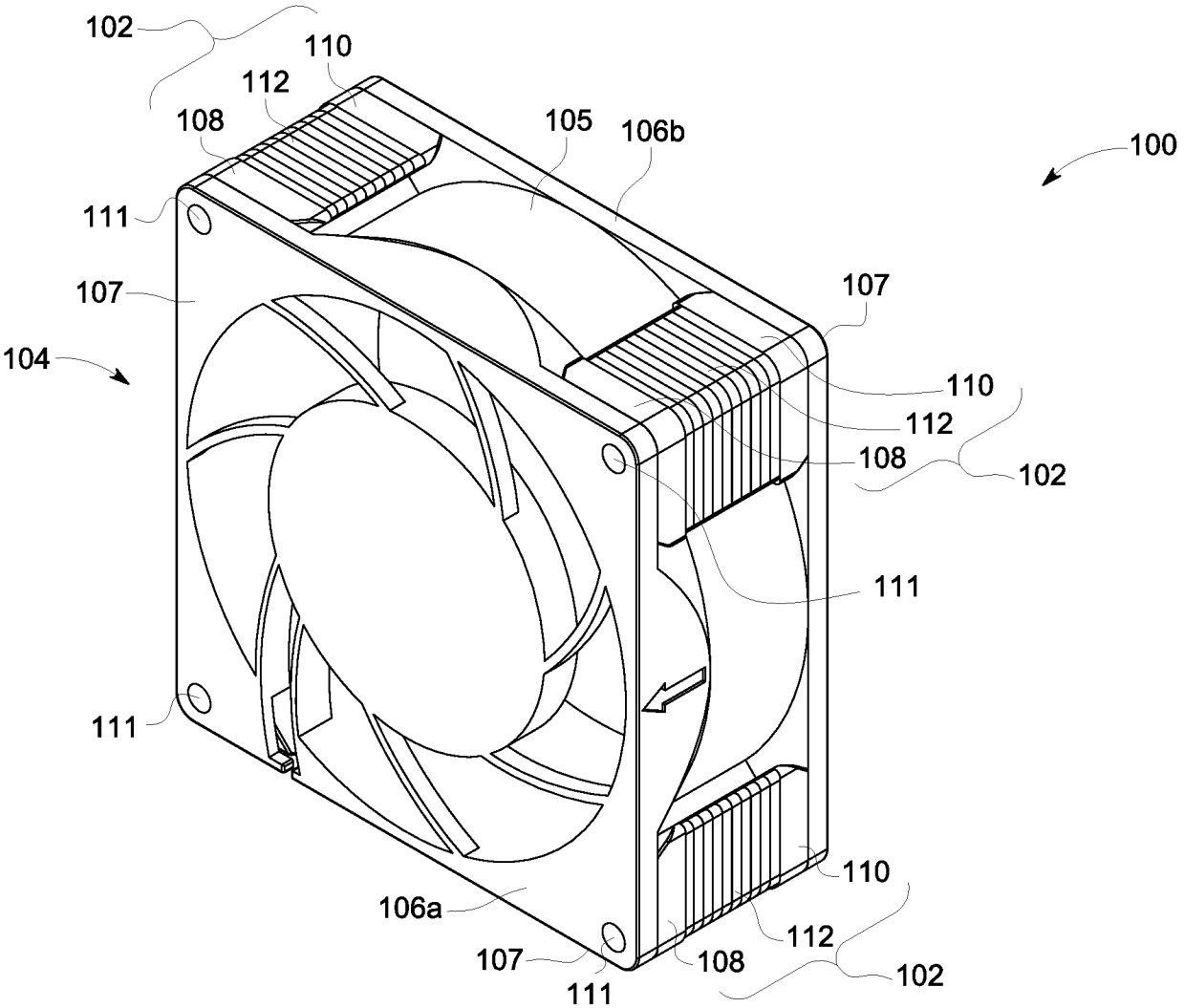
FIG. 2 illustrates an exemplary view depicting a fan assembled with a vibration damping device in accordance with an implementation of the present subject matter.

FIG. 2 illustrates an exemplary view depicting a fan 104 assembled with a plurality of vibration damping devices 102 in accordance with an implementation of the present subject matter (three vibration damping devices 102 shown, a fourth possible, though hidden). As illustrated in FIG. 1 and FIG. 2, vibration damping devices 102 can be disposed between the inlet side of frame 106*b* and the exhaust side of frame 106*a*. Here they are shown disposed at the corners 107 of the substantially rectangular frame 106 retaining the fan mechanism 105.

Figure 3:
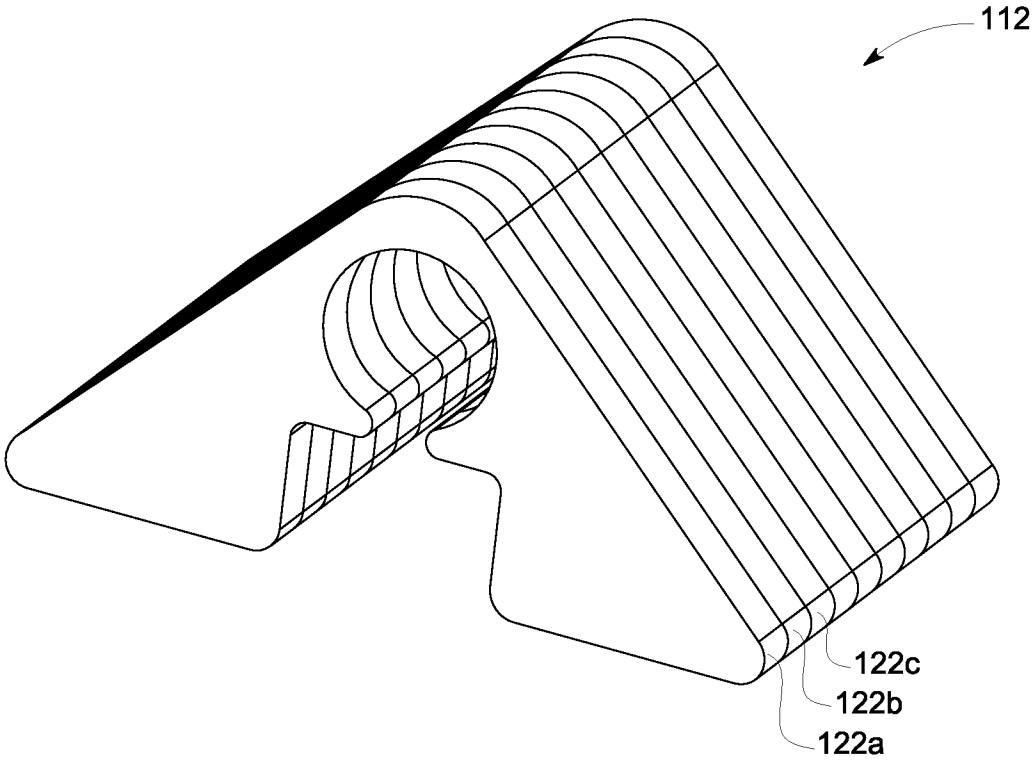
FIG. 3 illustrates an exemplary isometric view of a block including a plurality of plates with pre-defined mass in accordance with an implementation of the present subject matter.

FIG. 3 illustrates an exemplary isometric view of a block 112 including a plurality of plates 122*a*, 122*b*, and 122*c* (representative plates, identified, others not identified). The block 112 has a pre-defined mass $m_T$ in accordance with an implementation of the present subject matter. In an implementation, each of the plurality of plates is of substantially same mass. In another implementation, some one or more or all of the plurality of plates are of different masses relative to each other. As illustrated in FIG. 3, one or more plates, e.g., plates 122*a*, 122*b*, 122*c*, et al., with pre-defined mass can be stacked together to define a block 112 that defines a total mass $m_T$.

Figure 4:
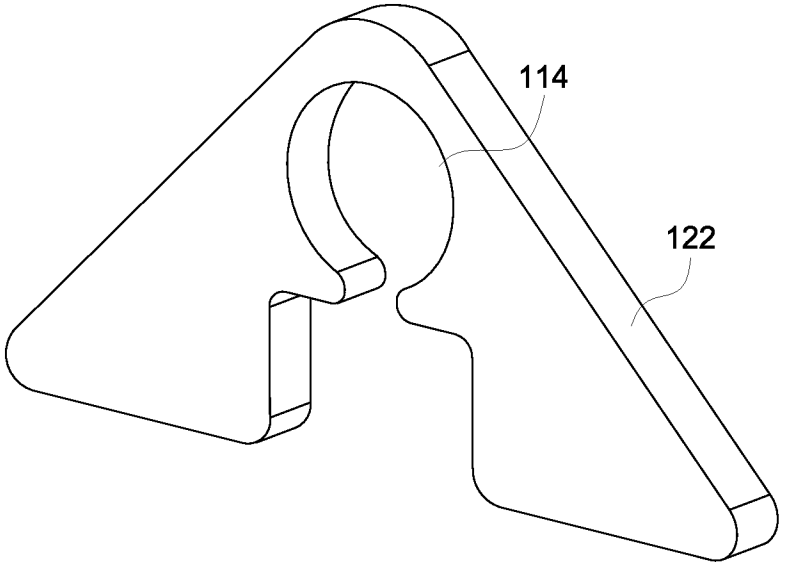
FIG. 4 illustrates an exemplary isometric view of a plate with pre-defined mass in accordance with an implementation of the present subject matter.

FIG. 4 illustrates an exemplary isometric view of a plate 122 with a pre-defined mass in accordance with an implementation of the present subject matter. The plate 122 can be made of any material known to or appreciated by a person skilled in the art including but not limited to metal, plastic, other polymeric material and the like as to serve its intended purpose as set forth in various implementations of the present disclosure. Preferably, the plate 122 is made of a metallic material selected from a group that may include iron or steel for example. The plate 122 can be made of any shape as known to or appreciated by a person skilled in the art including but not limited to triangular, hexagonal, square and the like so as to serve its intended purpose. In a preferred implementation, the plate 122 is made of a metal and is of substantially triangular shape, as shown in FIGS. 1-4, e.g. Further, the plate 122 may, as shown, define at least one aperture and/or groove 114 therein. Such an aperture or groove or both may be used to dispose the plate 122, on a rod or bolt or screw or like elongated member (not separately shown here) so as to be retained between resilient attachment members 108 and 110 between frame members 106*a* and 106*b*.

Figure 5:
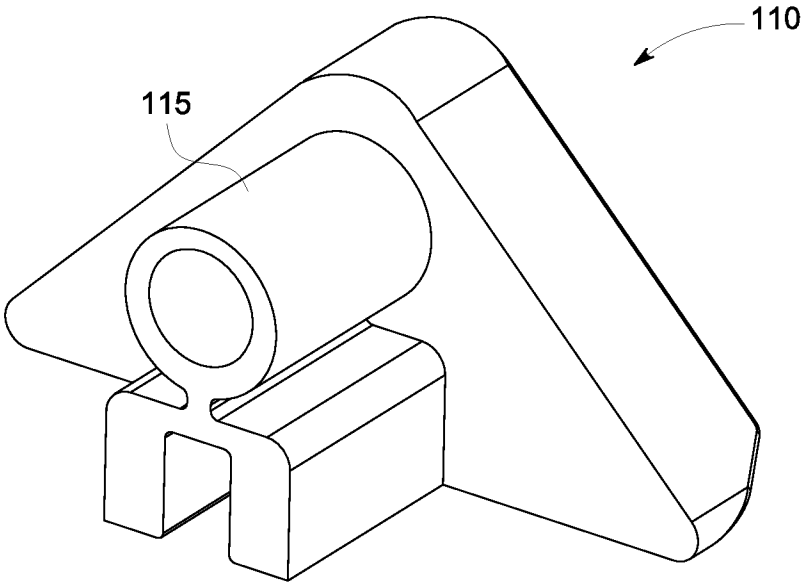
FIG. 5 illustrates an exemplary view of a resilient attachment member in accordance with an implementation of the present subject matter.

FIG. 5 illustrates an exemplary view of a resilient attachment member 110 in accordance with an implementation of the present subject matter. In an implementation, the resilient attachment member 110 defines a protrusion 115 thereon so as to detachably connect and retain a block 112 as shown for example in FIG. 1. The resilient attachment member 110 has inherent therein or associated therewith or defines a spring characteristic. In an implementation the spring characteristic is or may be represented by shore hardness. In another implementation, instead of two resilient attachment members 108, 110, a single resilient attachment member can be configured to attach the block or plate or plates to the frame. In some implementations, the spring characteristic can come from the resilient material used to make the attachment member; and in some instances that spring characteristic can be represented with a shore hardness $A_1$.

A vibration damping device 102, realized in accordance with implementations of the present disclosure, may be considered tunable to damp vibration of a fan 104 by any one or more or a combination of (a) varying the mass $m_T$ of block 112 by addition or subtraction of one or more plates 122, and/or (b) replacing at least one of the resilient attachment members 108 and 110 having a first spring characteristic with another or a second resilient attachment member having a second spring characteristic; and disposing the vibration damping device 102 between an inlet side of the frame 106*b* and an exhaust side of the frame 106*a* retaining the fan 104 to damp vibrations. In some implementations, the spring characteristic is represented by shore hardness.

Figure 6:
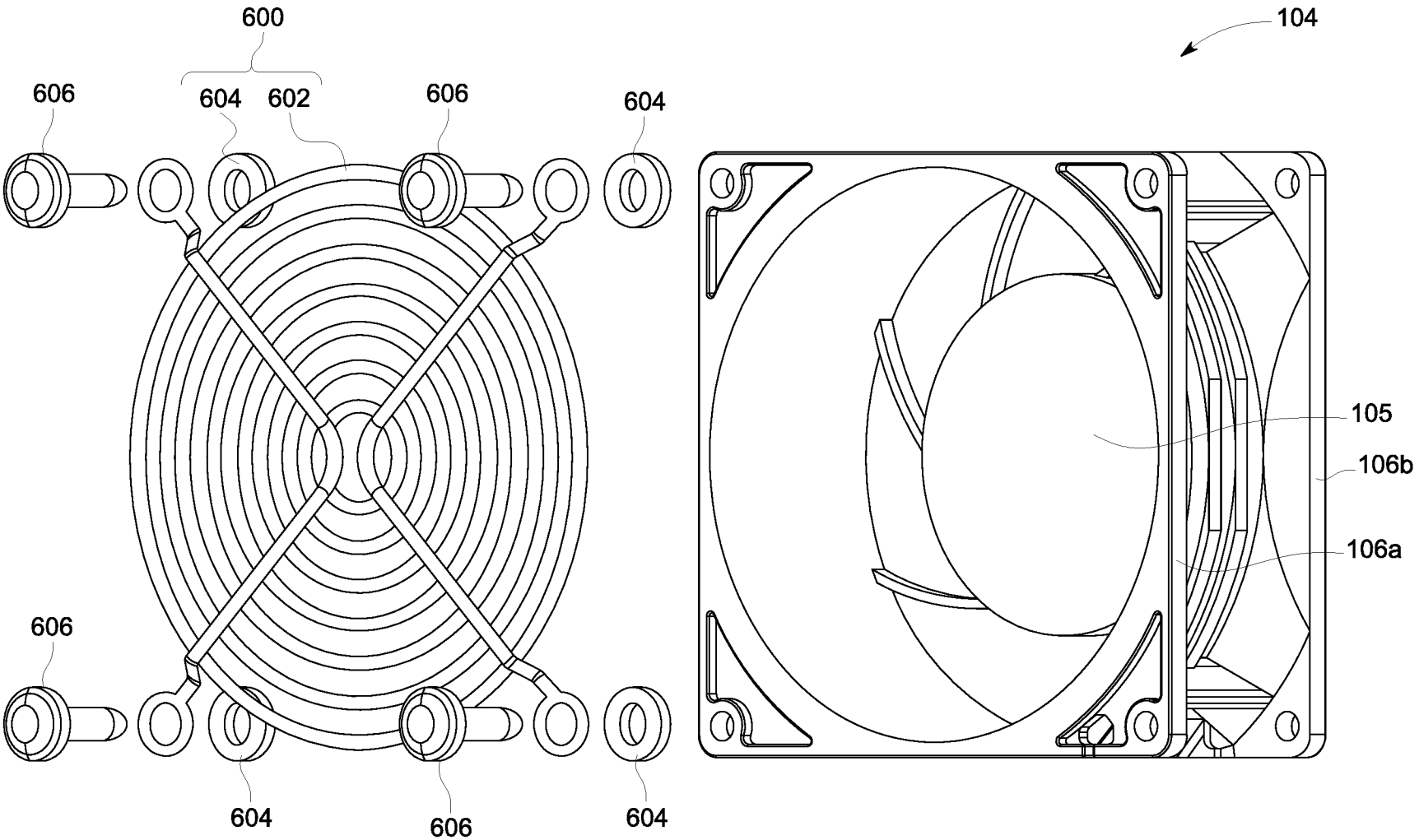
FIG. 6 illustrates an exemplary exploded view of a fan in combination with a vibration damping device including a finger guard and a resilient attachment member in accordance with an implementation of the present subject matter.
Figure 7:
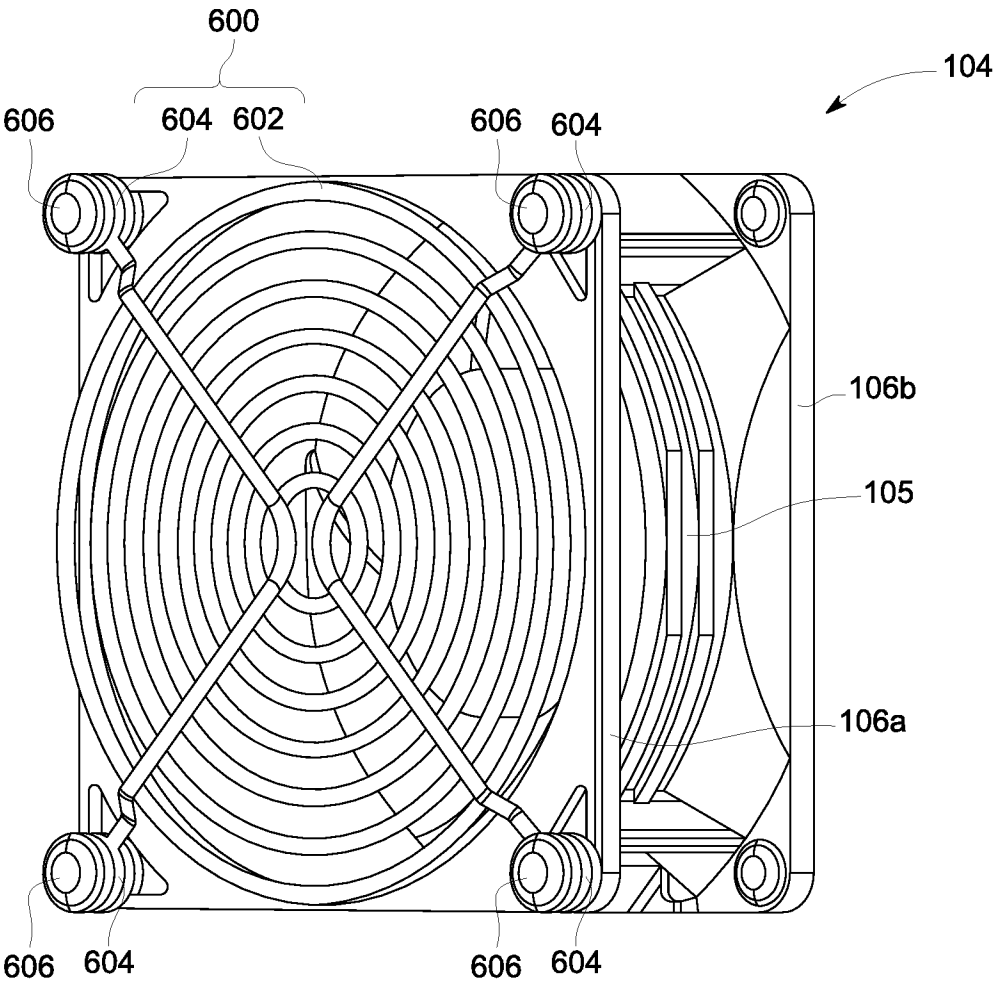
FIG. 7 illustrates an exemplary view depicting a fan assembled with a vibration damping device including a finger guard and a resilient attachment member in accordance with an implementation of the present subject matter.

In an alternative implementation, the mass $m_T$ including zero or more weight elements can be configured as a finger guard 602. FIG. 6 illustrates an exemplary exploded view of a fan 104 in combination with a vibration damping device 600 including a finger guard 602 and a resilient attachment member 604, in accordance with an implementation of the present subject matter. FIG. 7 illustrates an exemplary isometric view of a fan 104 assembled with a vibration damping device 600 including a finger guard 602 and a resilient attachment member 604, in accordance with an implementation of the present subject matter. As illustrated in FIG. 6 and FIG. 7, the fan 104 includes a frame 106 and a fan mechanism 105 (fan blades or like or alternative fan component parts not separately shown in FIG. 6 and FIG. 7) retained therein. In an implementation, the frame 106 is of substantially rectangular shape. Alternatively, it can be of any shape known to or appreciated by a person skilled in the art without departing form scope and spirit of the present disclosure. The frame 106 includes an inlet side of a frame 106*b* and an exhaust side of the frame 106*a*. One or more vibration damping device(s) 600 is/are disposed at any or a combination of the inlet side of the frame 106*b* and the exhaust side of the frame 106*a*. In an implementation, a rod or bolt or screw or like elongated member 606 can be used to retain the one or more vibration damping device(s) 600 at any or a combination of the inlet side of the frame 106*b* and the exhaust side of the frame 106*a*. The finger guard 602 with a mass $m_T$ can be coupled to the resilient attachment member 604 to realize a vibration damping device 600. The finger-guard 602 can be made of any material known to a person skilled in the art, including but not limited to metal, plastic, other polymeric material and the like as to serve its intended purpose as set forth in various implementations of the present disclosure. Preferably, the finger guard 602 is made of a metallic material selected from steel and iron, for example. The finger guard 602 can be connected to any or a combination of the inlet side of the frame 106*b* or the exhaust side of the frame 106*a* by resilient attachment members 604.

The vibration damping device 600, as illustrated in FIG. 6, realized in accordance with implementations of the present disclosure, may be considered tunable to damp vibration of a fan 104 by any one or more or a combination of (a) varying the total mass $m_T$ of finger-guard 602 by replacing it with a second or other finger-guard with a total mass $m_{T1}$, and/or (b) replacing the resilient attachment member 604 having the first spring characteristic with a second resilient attachment member having a second spring characteristic; and disposing the vibration damping device 600 at any or a combination of an inlet side of the frame 106*b* and an exhaust side of the frame 106*a* retaining the fan 104 to damp vibrations. In some implementations, the spring characteristic is represented by shore hardness.

Accordingly, an aspect of the present disclosure relates to a method of damping vibration of a fan 104, the method including: realizing a vibration damping device 102 by selecting a mass $m_T$ including zero or more weight elements (shown in FIGS. 1-5 as a block 112 including zero or more plates, and shown in FIG. 6 as a finger guard 602); selecting at least one resilient attachment member (shown in FIGS. 1-5 as including members 108 and 110, and shown in FIG. 6 as a member 604) having a first spring characteristic; and coupling the mass $m_T$ to the at least one resilient attachment member to realize the vibration damping device; tuning to damp the vibration of a the fan by any one or more or a combination of (a) varying the mass $m_T$ by replacement or addition or subtraction of one or more weight elements, and (b) replacing at least one resilient attachment member having a first spring characteristic with another resilient attachment member having a second spring characteristic; and disposing the vibration damping device 102 between or at any or a combination of an inlet side of the frame 106*b* and an exhaust side of the frame 106*a* retaining the fan 104 to damp vibrations of the fan 104.

Figure 8:
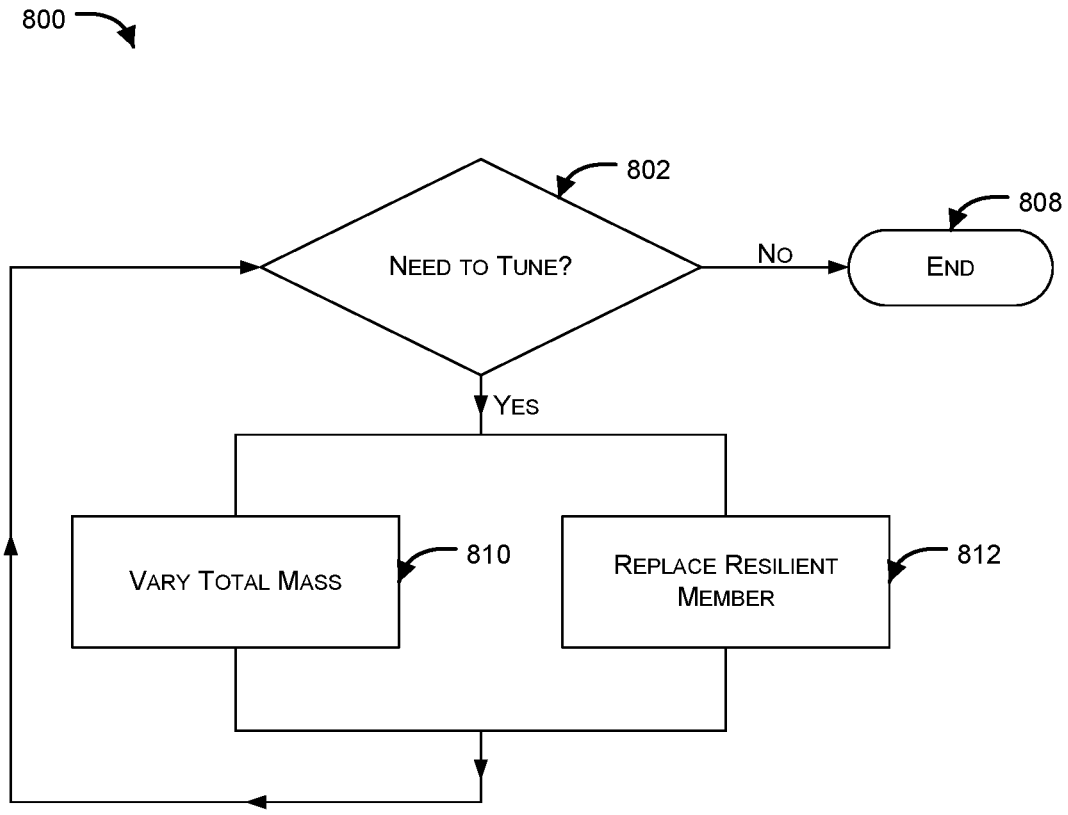
FIG. 8 illustrates an exemplary flow chart depicting tuning of the vibration damping device including a mass $m_T$ including zero or more weight elements and at least one resilient attachment member in accordance with an implementation of the present subject matter.

In an implementation, the tuning to damp the vibration of the fan can simply include varying and/or replacing elements of the vibration damping device such that overall vibration and noise emanating from the fan is reduced. In an alternative implementation, tuning to damp vibration of the fan includes: matching the resonance frequency of the fan by (a) varying or (b) replacing elements of the vibration damping device. FIG. 8 illustrates a flow chart 800 depicting an exemplary tuning of a vibration damping device in accordance with an implementation of the present disclosure. As shown in FIG. 8, in a first operation 802, a determination of whether tuning is desired or needed is done. Then, in second alternative operations 810 and/or 812, the mass $m_T$ is varied by replacement of finger guard having mass $m_T$ with another finger guard having mass $m_{T1}$, in case the mass $m_T$ is configured as a finger guard, or by addition or subtraction of one or more plates in the block, in case the mass $m_T$ is configured as a block including zero or more plates, and/or the resilient member is changed out for another of different resiliency. When no further need for tuning exists, for example, when overall vibration and noise emanating from the fan is reduced or eliminated or when resonance frequency of the vibration damping device matches that of the fan, the process 800 moves to end 808.

In an implementation, the tuning to damp the vibration of the fan includes one or more of: calculating a resonance frequency $f_1$ for the fan; calculating a resonance frequency f2 for the vibration damping device including the mass $m_T$ and the at least one resilient attachment with the shore hardness A1; comparing the resonance frequency f1 of the fan with the resonance frequency f2 of the vibration damping device; wherein in case of a mismatch between the resonance frequency f1 of the fan and the resonance frequency f2 of the vibration damping device, either or both (a) the varying the mass $m_T$ by replacement or addition or subtraction of one or more weight elements, and (b) the replacing of the at least one resilient attachment member having a first spring characteristic with another resilient attachment member having a second spring characteristic are performed to arrive at a resonance frequency f3 that matches the resonance frequency f1 of the fan. In an implementation, the mass $m_T$ is one or more of: (a) a block including as the zero or more weight elements, zero or more plates and (b) a finger guard, wherein the block is configured to be connected to the frame between the inlet side of the frame and the exhaust side of the frame, and the finger guard is configured to be connected onto any or a combination of the inlet side of the frame and the exhaust side of the frame retaining the fan mechanism.

Figure 9:
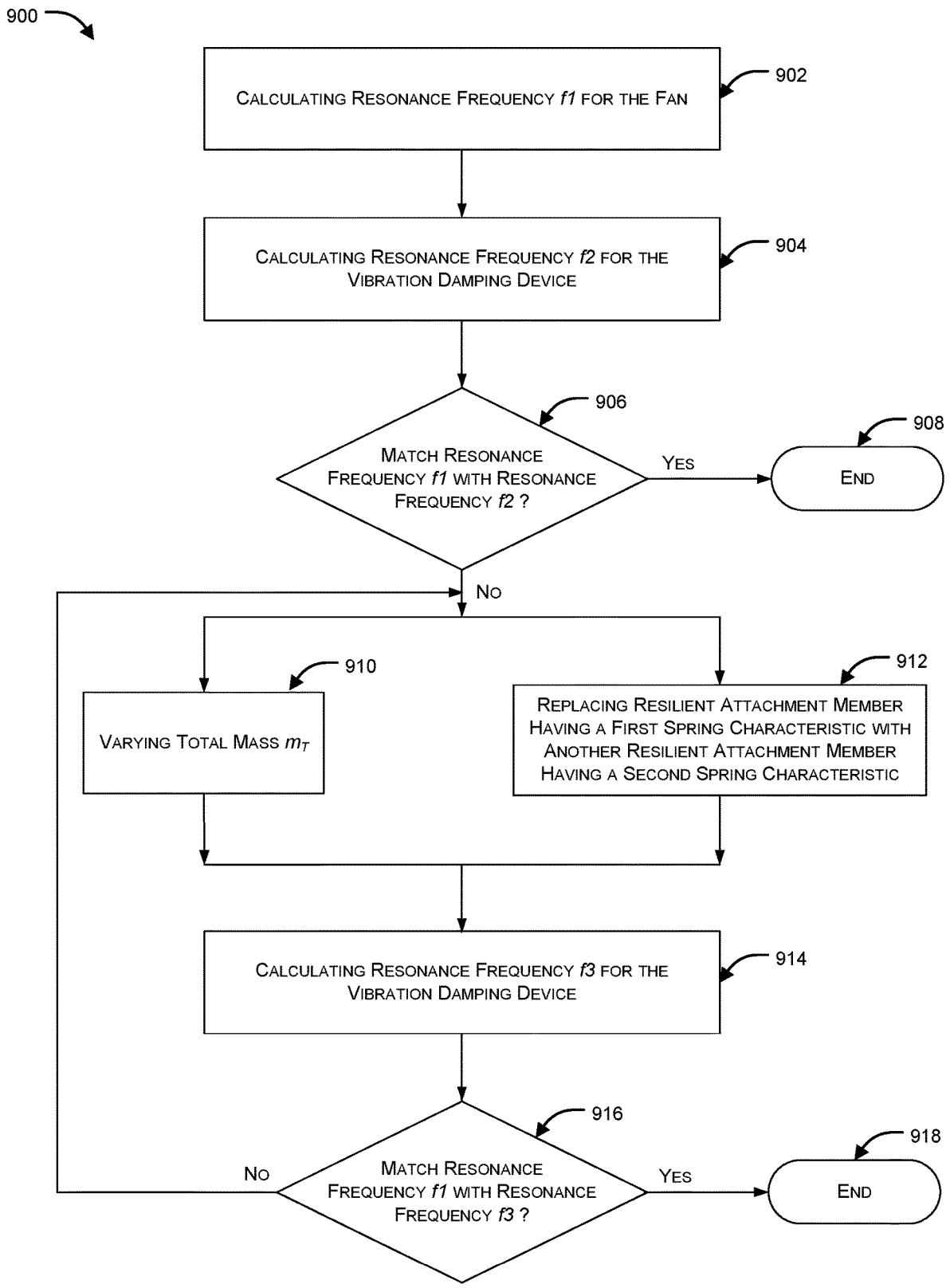
FIG. 9 illustrates an exemplary flow chart depicting tuning of the vibration damping device with mass $m_T$ including zero or more weight elements and at least one resilient attachment member in accordance with an implementation of the present subject matter.

FIG. 9 illustrates a flow chart depicting an alternative operation of tuning of the vibration damping device including a mass $m_T$ (configured either as a block 112 or as a finger-guard 602) and at least one resilient attachment member (108/110 or 604) in accordance with an implementation of the present disclosure. As shown as operation 902, resonance frequency $f_1$ for fan is calculated using any method known to a person skilled in the art. Then, as shown as operation 904, a resonance frequency f2 for vibration damping device including a mass $m_T$, either a block 112 or a finger-guard 602, and at least one resilient attachment with the shore hardness A1 is calculated. As shown as operation 906, resonance frequency f1 of fan is compared with resonance frequency f2 of vibration damping device. In case, resonance frequency of the fan f1 matches that of vibration damping device, no further tuning of the vibration damping device is required and the vibration damping device can be disposed between or at any or a combination of an inlet side of the frame and an exhaust side of the frame, as shown as operation 908. In case of a mismatch between the resonance frequency f1 of fan and the resonance frequency f2 of vibration damping device, either or both (a) the total mass $m_{T'}$ of block or finger-guard is varied by replacing one or more plates and/or the finger-guard with total mass $m_T$ with other plates (or adding or subtracting plates) or a finger-guard with total mass $m_{T1}$, as shown at operation 910, and/or (b) at least one resilient attachment member having a first spring characteristic is replaced with another resilient attachment member having a second spring characteristic, as shown at operation 912, are performed to arrive at a new resonance frequency f3. As shown at operation 914, the new resonance frequency f3 is calculated utilizing any method known to a person skilled in the art. Resonance frequency f3 can then be matched with resonance frequency f1, as shown at operation 916. In case the resonance frequency f3 found to be matched with resonance frequency f1, the process moves to the end. The tuned vibration damping device can then be disposed between or at any or a combination of an inlet side of the frame and an exhaust side of the frame retaining the fan mechanism therein, as shown at 918. In an alternative implementation, the tuning to damp the vibration of the fan can simply include varying and/or replacing elements of the vibration damping device such that overall vibration and noise emanating from the fan is reduced.

Resonance frequency can be calculated utilizing any methods known to a person skilled in the art. In an exemplary implementation, following method can be used to calculate resonance frequencies for the fan (acting as a primary mass) and the vibration absorption device (acting as a secondary mass). The resonance frequencies can be matched and consequently used for fan vibration damping. The fan (primary mass) exhibits multiple degrees of freedom. As the fan is typically mounted to a frame or a supporting structure of the system, such a mounting mechanism and its stiffness can be used in a simple first-order analysis for modeling the fan. Thus, based on the stiffness of mounting mechanism, the fan can be modeled as a lumped mass system having a simple spring-mass relationship, with a mass m of the fan and an effective fan mounting stiffness constant, $K_{eff}$, wherein $K_{eff}$ is a constant based on how the fan is mounted and the type of material used for the corresponding mounting structure in the system. Similarly, vibration damping device can be modeled as a lumped mass system having a simple spring-mass relationship. Accordingly, following formula can be used to calculate natural frequency of the fan and/or the vibration damping device:

$$f_{(hs)} = \frac{1}{2\pi}\sqrt{\left(\frac{K_{(lb/in)}}{W_{(lb)}}\right)\times 386_{(in/sec^2)}}$$

where "K" is stiffness of the mounting mechanism, and "W" is the weight (mass) of the fan.

Resonance frequency of the fan can then be obtained or measured by exciting or vibrating it at different frequencies, such as a frequency range, with an external actuator. The displacements of the fan (which indicate physical vibrations of the fan) can then be measured at the excited frequencies to determine the resonant frequency of the fan, using the following formula:

$$V=\pi FD$$

Where, D=displacement of the fan, V=velocity of the fan, A=acceleration of the fan and F=frequency.

In an implementation, the system is placed or mounted on a vibration table, which acts as an external actuator. One or more accelerometers or other displacement sensing devices are then mounted on the fan at a rigid location to measure displacement of the fan. A frequency sweep is performed on the system, wherein the system is stepped through various different vibrating frequencies, as produced by an external actuator, such as a vibration table, to which the system is coupled. For example, the vibration table is activated to vibrate at various different frequencies while the accelerometers are used to measure the displacement of the fan in the system (which is mounted on the vibration table). In addition, the system may be placed on the vibration table at multiple different orientations for each frequency sweep. Alternatively, any known external actuator(s) other than a vibration table can be used to provide excitation or vibration of the system.

In another implementation, resonant frequency of the fan is determined by identifying vibrating frequency at which the fan exhibits largest displacement amplitude or one that is substantially higher than other amplitudes at other vibrating frequencies, as sensed by the accelerometers. In the case where there are multiple orientations for placement of the system, multiple resonant frequencies are identified. It should be understood that for each determined resonant frequency, any of the associated harmonic frequencies also may be considered significant for contribution to the vibration of the system and components therein.

In another implementation, instead of implementing accelerometers or other displacement sensing devices to measure displacement of the fan, a throughput software program or application can be implemented in the system to obtain the throughput of the fan. Any commercially available throughput software or application can also be employed. The vibrating frequency (or frequencies) at which the fan exhibits undesired levels of throughputs can be determined to be the undesired vibrating frequencies of the fan.

In a further implementation, stiffness/hardness of resilient attachment member and total weight (mass) of vibration damping device (secondary mass) is adjusted such that the resonant frequency of the secondary mass matches the resonant frequency of the fan (primary mass) and motion of the primary mass is substantially reduced at its resonant frequency. In turn, energy of the primary mass (fan) is substantially absorbed by the tuned vibration damping device. Adjustment of the weight (mass) of the metal block is effected by addition or removal of one or more metal plates. Alternatively, in case of a fan configured with a finger-guard, adjustment of the weight (mass) of the finger-guard can be done by replacing the finger-guard with another finger-guard of desired mass (or weight).

In an alternative implementation, resonance frequencies f1 and f2 are first determined using any method known to a person skilled in the art. The resonance frequencies f1 and f2 are then compared and checked for matching. In the event of mismatching, the stiffness/hardness of the resilient attachment member and/or the total weight (mass) of the vibration damping device (secondary mass) are modified/tuned such that the resonant frequencies match or are at least drawn closer. Resonance frequency f3 of the vibration damping device is determined again. Resonance frequencies f1 and f3 are then compared and checked for matching. The above-mentioned steps are iteratively performed till the resonance frequency of the fan and vibration damping device correspond with each other and thus the motion of the primary mass is reduced to zero at its resonance frequency.

Accordingly, another aspect of the present disclosure relates to a vibration damping system, the system including: a fan including: a fan mechanism; an inlet side of a frame; and an exhaust side of the frame, the frame retaining a fan mechanism therewithin; and, a vibration damping device configured to be connected to the frame, the vibration damping device including: a mass $m_T$ including zero or more weight elements; and at least one resilient attachment member having a first spring characteristic, wherein the at least one resilient attachment member is configured to be connected to and retain the mass $m_T$ between or at any or a combination of the inlet side of the frame and the exhaust side of the frame retaining the fan mechanism; wherein the vibration damping device is tunable to damp the vibration of a the fan by any or a combination of (a) varying the mass $m_T$ by replacement or addition or subtraction of one or more weight elements, and (b) replacing the at least one resilient attachment member having the first spring characteristic with a second resilient attachment member having a second spring characteristic.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. Within the context of this document terms "coupled to" and "coupled with" are also used euphemistically to mean "communicatively coupled with" over a network, where two or more devices are able to exchange data with each other over the network, possibly via one or more intermediary device.

It should be apparent to those skilled in the art that many more modifications besides those already described are possible without departing from the concepts herein. The current subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc. The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

While embodiments of the present disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

What is claimed is:

1. A vibration damping device for a fan, the fan including an inlet side of a frame and an exhaust side of the frame, the frame retaining a fan mechanism; the vibration damping device comprising:

a mass $m_T$ comprising one or more solid weight elements; and at least one solid resilient attachment member having a first spring characteristic, wherein said at least one solid resilient attachment member is configured to be connected to the frame and said mass $m_T$ and retain said mass $m_T$ between the inlet side of the frame and the exhaust side of the frame;

wherein said vibration damping device is tunable to damp the vibration of the fan by at least one or a combination of (a) varying the mass $m_T$ by replacement or addition or subtraction of one or more solid weight elements, and (b) replacing said at least one solid resilient attachment member having the first spring characteristic with a second solid resilient attachment member having a second spring characteristic; and said at least one solid resilient attachment is made of a rubber material.

2. A vibration damping device for a fan, the fan including an inlet side of a frame and an exhaust side of the frame, the frame retaining a fan mechanism; the vibration damping device comprising:

a mass $m_T$ comprising one or more solid weight elements; and at least one solid resilient attachment member having a first spring characteristic, wherein said at least one solid resilient attachment member is configured to be connected to the frame and said mass $m_T$ and retain said mass $m_T$ between the inlet side of the frame and the exhaust side of the frame;

wherein said vibration damping device is tunable to damp the vibration of the fan by at least one or a combination of (a) varying the mass $m_T$ by replacement or addition or subtraction of one or more solid weight elements, and (b) replacing said at least one solid resilient attachment member having the first spring characteristic with a second solid resilient attachment member having a second spring characteristic;

wherein the mass $m_T$ comprises a block comprising as the one or more solid weight elements, one or more plates; and said one or more plates are made of a metallic material.

3. A vibration damping device for a fan, the fan including an inlet side of a frame and an exhaust side of the frame, the frame retaining a fan mechanism; the vibration damping device comprising:

a mass $m_T$ comprising one or more solid weight elements; and at least one solid resilient attachment member having a first spring characteristic, wherein said at least one solid resilient attachment member is configured to be connected to the frame and said mass $m_T$ and retain said mass $m_T$ between the inlet side of the frame and the exhaust side of the frame;

wherein said vibration damping device is tunable to damp the vibration of the fan by at least one or a combination of (a) varying the mass $m_T$ by replacement or addition or subtraction of one or more solid weight elements, and (b) replacing said at least one solid resilient attachment member having the first spring characteristic with a second solid resilient attachment member having a second spring characteristic;

wherein the mass $m_T$ comprises a block comprising as the one or more solid weight elements, one or more plates; and said one or more plates are one or both of substantially triangular shape and having at least one groove defined therein.

4. A method of damping vibration of a fan, the method comprising:

realizing a vibration damping device by:

selecting a mass $m_T$ comprising one or more solid weight elements;

selecting at least one solid resilient attachment member having a first spring characteristic; and coupling said mass $m_T$ to said at least one solid resilient attachment member to realize the vibration damping device;

tuning to damp the vibration of the fan by at least one or a combination of (a) varying the mass $m_T$ by replacement or addition or subtraction of one or more solid weight elements, and (b) replacing said at least one solid resilient attachment member having a first spring characteristic with another solid resilient attachment member having a second spring characteristic; and disposing and retaining said vibration damping device between an inlet side of a frame and an exhaust side of the frame retaining said fan to damp vibrations of said fan by connecting the vibration damping device to the inlet side of the frame and the exhaust side of the frame.

5. The method of claim 4, wherein the tuning to damp the vibration of the fan includes:

matching the resonance frequency of the fan by the (a) varying or the (b) replacing of elements of the vibration damping device.

6. The method of claim 4, wherein the tuning to damp the vibration of the fan comprises one or more of:

calculating a resonance frequency $f_1$ for the fan;

calculating a resonance frequency $f_2$ for the vibration damping device comprising the mass $m_T$ and the at least one solid resilient attachment with the shore hardness A1;

comparing the resonance frequency $f_1$ of said fan with the resonance frequency $f_2$ of said vibration damping device;

wherein in case of a mismatch between the resonance frequency $f_1$ of said fan and the resonance frequency $f_2$ of said vibration damping device, either or both (a) the varying the mass $m_T$ by replacement or addition or subtraction of one or more solid weight elements, and (b) the replacing of said at least one solid resilient attachment member having a first spring characteristic with another solid resilient attachment member having a second spring characteristic are performed to arrive at a resonance frequency $f_3$ that matches the resonance frequency $f_1$ of said fan.

7. The method of claim 4, wherein the mass $m_T$ comprises a block comprising as the one or more solid weight elements, one or more plates.

8. The method of claim 4, wherein said at least one solid resilient attachment member is made of a rubber material.

9. The method of claim 4, wherein said at least one solid resilient attachment member defines at least one protrusion thereon.

10. The method of claim 7, wherein said one or more plates are made of a metallic material.

11. The method of claim 7, wherein said one or more plates are of substantially triangular shape.

12. The method of claim 4, wherein said frame is a substantially rectangular frame that is configured to retain said fan.

13. The method of claim 12, wherein said vibration damping device is coupled to said substantially rectangular frame at its corners.

14. A vibration damping system, the system comprising:

a fan including:

a fan mechanism;

an inlet side of a frame; and an exhaust side of the frame, the frame retaining the fan mechanism therewithin; and, a vibration damping device configured to be connected to the frame, the vibration damping device including:

a mass $m_T$ comprising one or more solid weight elements; and at least one solid resilient attachment member having a first spring characteristic, wherein said at least one solid resilient attachment member is configured to be connected to the frame and said mass $m_T$ and retain said mass $m_T$ between the inlet side of the frame and the exhaust side of the frame retaining the fan mechanism;

wherein said vibration damping device is tunable to damp the vibration of a the fan by at least one or a combination of (a) varying the mass $m_T$ by replacement or addition or subtraction of one or more solid weight elements, and (b) replacing said at least one solid resilient attachment member having the first spring characteristic with a second solid resilient attachment member having a second spring characteristic.

15. The vibration damping system of claim 14, wherein said vibration damping device is tunable to damp the vibration of the fan by being tunable to match resonance frequency of said fan.

16. The vibration damping device of claim 14, wherein said at least one solid resilient attachment member having the first spring characteristic is made of a first material that has a shore hardness $A_1$ and the second solid resilient attachment member having the second spring characteristic is made of a second material that has a shore hardness $A_2$.

* * * * *